United States Patent [19]

Kopp

[11] Patent Number: 4,599,850

[45] Date of Patent: Jul. 15, 1986

[54] METHOD AND APPARATUS FOR DRIVING SEALING ELEMENTS IN A PACKING MACHINE

[75] Inventor: Georg Kopp, Uhwiesen, Switzerland

[73] Assignee: SIG Schweizerische Industrie-Gesellschaft, Neuhausen am Rheinfall, Switzerland

[21] Appl. No.: 636,014

[22] Filed: Jul. 30, 1984

[30] Foreign Application Priority Data

Jul. 29, 1983 [CH] Switzerland ..... 4177/83

[51] Int. Cl.[4] ..... B65B 9/02; B65B 65/04

[52] U.S. Cl. ..... 53/451; 53/477; 53/551; 53/554; 156/583.1

[58] Field of Search ..... 53/450, 451, 477, 545, 53/548, 550, 551, 552, 553, 554; 156/515, 553, 583.1, 583.4; 493/208

[56] References Cited

U.S. PATENT DOCUMENTS 2,982,066 5/1961 Thompson ..... 53/553
3,383,269 5/1968 Kopp .
3,776,804 12/1973 Monahan et al. ..... 156/515

FOREIGN PATENT DOCUMENTS 416434 1/1967 Switzerland .
904519 8/1962 United Kingdom .

*Primary Examiner*—E. R. Kazenske
*Assistant Examiner*—Michael D. Folkerts
*Attorney, Agent, or Firm*—Spencer & Frank

[57] ABSTRACT

A packing machine for making filled and sealed bags from superposed wrapper sheets, has a pair of cooperating sealing rollers for providing longitudinal seams on the superposed wrapper sheets passed therebetween; a mechanism for rotating unidirectionally the sealing rollers in first and second consecutive steps for providing the longitudinal seams in two consecutive length portions, each corresponding to one-half of the predetermined length; a pair of cooperating sealing shoes movable towards and away from one another for assuming, respectively, a sealing position to provide a transverse seam on the superposed wrapper sheets and an idling position; and a mechanism for moving the sealing shoes, while in the sealing position, codirectionally with the travelling direction of the wrapper sheets during a period in which one of the two steps is performed and for moving the sealing shoes, while in the idling position, against the travelling direction during a period in which the other of the two steps is performed.

13 Claims, 3 Drawing Figures

METHOD AND APPARATUS FOR DRIVING SEALING ELEMENTS IN A PACKING MACHINE

BACKGROUND OF THE INVENTION

This invention relates to a method and an apparatus for driving sealing elements in a packing machine for the continuous manufacture of filled and sealed bags.

In packing machines which produce filled bags it is a desideratum to vary the size of the bags and thus the quantity of goods contained therein. British Patent No. 904,519 has resolved this object by providing two webs of a wrapper material which are introduced to a sealing station by shaping shoulders. The sealing station is formed by two sealing rollers which may be moved towards and away from one another and which have edge portions for forming opposite longitudinal seams and also have a transversal sealing shoe for forming transverse seams in the bags. When the rollers of the sealing roller pair are pressed to one another, bags of a predetermined length are formed. Control means are provided for moving the sealing rollers away from one another to thus vary the length of the bags. In wrapper films made of heat sealable material, however, the sealing rollers have to be maintained at relatively high temperatures in order to ensure that airtight seams are produced. Such an arrangement may lead to excessive heat effects which may cause, for example, caramelization in case sugar products are being wrapped.

In the system according to U.S. Pat. No. 4,291,520 there are provided, in contradistinction to the apparatus disclosed in the above-discussed British patent, two separate sealing stations for the longitudinal seams on the one hand and the transverse seams on the other hand. The drawing of the wrapper sleeve is effected by means of separate drive arrangements. The transverse sealing shoes are driven separately and travel with the bag along a length portion of its travelling path. In case the wrapper sleeve is drawn intermittently, the effect on the heat output of the longitudinal sealing arrangement is substantial because the film material is moved non-uniformly through the sealing station and thus differently heated zones are formed. In this apparatus, however, the bag lengths may be varied relatively simply by changing the delivery speed of the film. It is, however, a disadvantage of this arrangement that a synchronization of all three component units, that is, the control of the longitudinal sealing means, the web drawing device and the motion of the transverse sealing shoes has to be ensured in case the bag length is to be changed.

SUMMARY OF THE INVENTION

It is an object of the invention to provide an improved driving arrangement for sealing elements in packing machines ensuring a simple setting and adjustment of the bag lengths.

These objects and others to become apparent as the specification progresses, are accomplished by the invention, according to which, briefly stated, the sealing rollers which form the longitudinal seams in the bag are rotated in the same sense in increments which correspond to one-half of the bag length and the transverse sealing shoes, for forming the transverse seams, perform a sealing stroke and a return stroke during the same period as that needed for the incremental step performed by the longitudinal sealing rollers, and further, the transverse sealing shoes are in engagement with one another at least approximately during the entire sealing stroke.

DESCRIPTION OF THE PREFERRED EMBODIMENT

Figure 1:
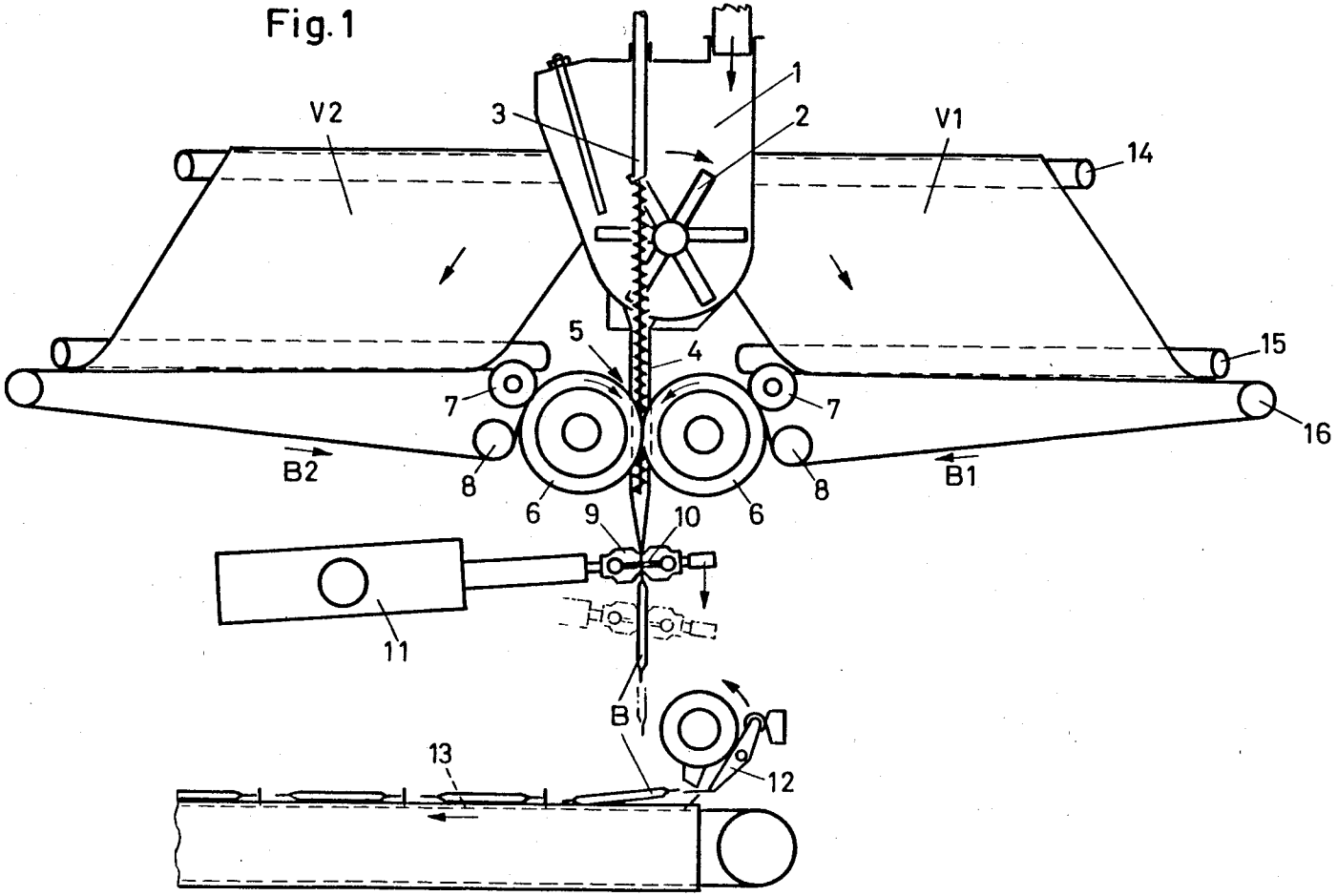
FIG. 1 is a schematic side elevational view of a preferred embodiment of the invention.

Turning now to FIG. 1, there is shown a packing machine which has a charging chute 1 in which there is disposed a vane impeller 2 and a vertically oriented conveyor screw 3 surrounded by a hollow filler mandrel 4 extending from the bottom of the chute 1. Underneath the chute 1 there is arranged a sealing station 5 which includes a pair of cooperating sealing rollers 6. With each sealing roller 6 there is associated a circular knife 7 and a deflecting roller 8 situated below the respective knife 7. Downstream of the sealing station 5, as viewed in the direction of article advance, there is arranged a transverse heat-sealing mechanism 9 which has transverse severing knives 10 and which is actuated by a drive 11 for an oscillating motion between a phantom-line position and a solid-line position. The drive for such a transverse sealing arrangement may be similar to that disclosed in U.S. Pat. No. 4,291,520. The individually delivered filled bags B are grasped by grippers 12 and deposited onto a conveyor belt 13.

The division of the sheet-like wrapper material into two partial webs V1 and V2 may be effected in a manner disclosed in Swiss Patent No. 416,434. For the sake of simplicity, the supply reel and the severing knife behind the filler chute 1 are not illustrated. The two partial webs V1 and V2 are, subsequent to longitudinal division (severing), guided over a first guide roller 14, then a second guide roller 15 and a third guide roller 16 to thus form oppositely running webs B1 and B2.

From the respective deflecting rollers 8 the webs B1 and B2 are introduced onto the respective sealing roller 6. The hollow mandrel 4 is shaped to handle a predetermined kind of material. The material which may be dosed, for example, by previous weighing, may be charged by the hollow mandrel 4 from the chute 1 into the bags by gravity.

Figure 2:
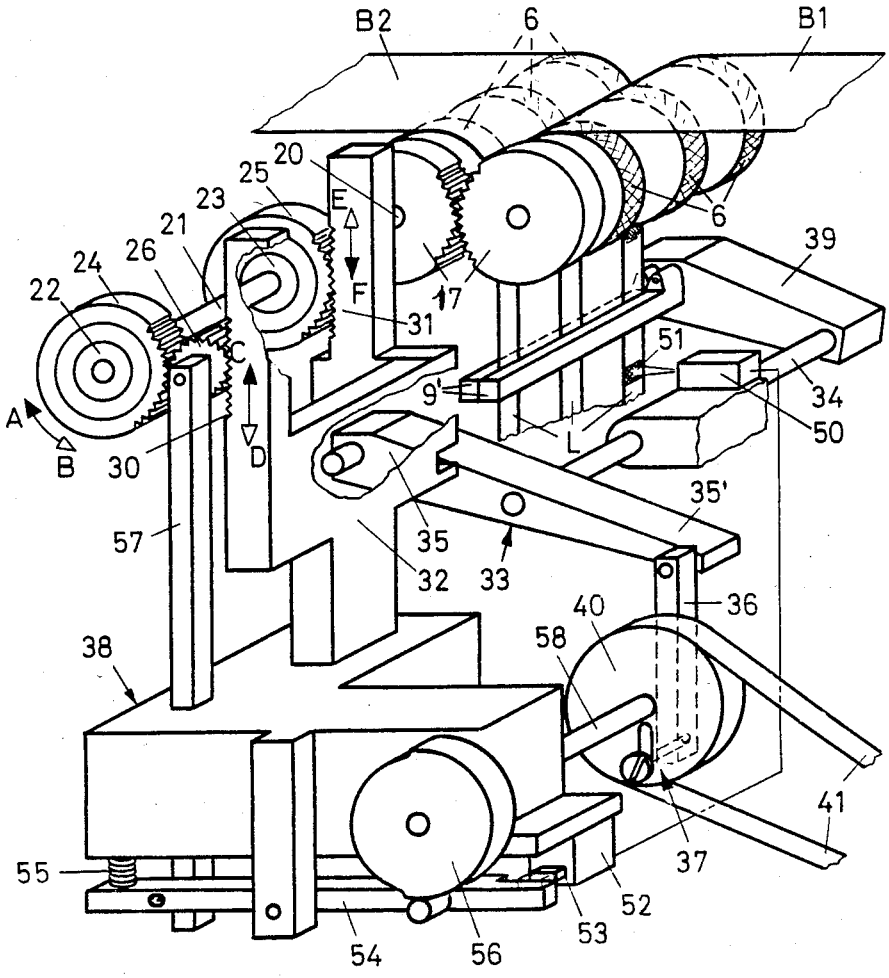
FIG. 2 is a perspective view of the preferred embodiment.

Turning now to FIG. 2, the two webs B1 and B2 are shown as they run onto the sealing rollers 6. For clarity, the webs B1 and B2 are shown to be looped around the rollers 6 to a lesser extent than that which is correctly illustrated in FIG. 1. The two sealing rollers 6 are coupled to one another by means of a pair of gears 17 ensuring synchronous opposite rotation thereof.

The transverse sealing shoes 9' are only schematically illustrated; the drive for opening or closing these shoes is not shown, particularly since such a drive is of conventional nature and has no bearing on the invention. The drive may be of the type disclosed in the earlier-mentioned U.S. Pat. No. 4,291,520.

The shaft 20 of one of the sealing rollers 6 carries, on an extension (drive shaft) 21, gears 24 and 25 supported on freewheeling arrangements 22, 23, respectively. The freewheeling arrangements (including one-way clutches) are well known components and may be, for example, Model NSS parts manufactured by the Stieber division of the Borg-Warner Corporation. This arrangement ensures that both gears 24 and 25 are, in the rotary direction of the arrow A, rigidly (torque-transmittingly) coupled with the drive shaft 21, whereas in the direction of arrow B they rotate freely with respect to the drive shaft 21.

Two toothed racks 30, 31 are interconnected by means of a carrier 32 to form a unitary fork-like component. On the carrier 32 there is articulated a two-armed lever 33 affixed, approximately at its middle, to a shaft 34 which is rotatably supported on the machine frame of the packing machine. At the end 35' which is opposite to the articulation of the two-armed lever 33 with the carrier 32, a connecting rod 36 is articulated which, at its other end, is jointed to an eccentric drive 37.

The carrier 32 is guided for a back-and-forth vertical linear motion in a guide block 38.

The gear 25 directly meshes with the toothed rack 31, whereas the other gear 24 is connected with the other toothed rack 30 with the intermediary of an idling pinion 26. By virtue of the identical construction of the gears 24 and 25 and their freewheeling (one-way clutch) arrangements 22 and 23 and the intermediate gear (pinion) 26, a displacement of the toothed rack 30 in the direction of the arrow C effects a rotation of the gear 24 in the direction of the arrow A. If the toothed rack 30 moves in the opposite direction as indicated by the arrow D, the rotation of the gear 24 imparted thereto by the pinion 26 will transmit no torque on the extension 21 of the shaft 20.

Conversely, a motion of the toothed rack 31 in the direction of the arrow E causes a rotation of the gear 25 in the direction of the arrow B which is thus a freewheeling motion. If the toothed rack 31 is displaced in the direction of the arrow F, the rotation of the gear 25 transmits a torque to the drive shaft 21. It is noted that directional arrows showing displacements causing working motion (working stroke) of the sealing rollers 6 are shown as full-headed arrows (A, C and F) whereas those displacements which do not transmit a driving torque to the sealing rollers 6 are indicated by arrow heads shown in outline only (arrows B, D and E).

The above-described arrangement thus effects a two-stage rotation of the sealing rollers 6. In the first stage rotation of the sealing rollers 6 in the direction of the arrow A takes place as the rack assembly 30, 31, 32 moves in the direction of the arrow C, and in the second stage rotation of the sealing rollers 6 occurs, again in the direction of arrow A, as the rack assembly 30, 31, 32 moves in the direction of the arrow F.

The transverse sealing shoes 9' are connected with the shaft 34 by a lever 39, whereby a motion of the eccentric drive 37 is transmitted to the sealing shoes 9'. In this manner, the sealing rollers 6 advance the bags upon each revolution of the drive 37 by a predetermined extent and, at the same time, the transverse sealing shoes 9' execute a back-and-forth motion. By means of the arrangement illustrated in FIG. 2, the stroke of the transverse sealing shoes 9' is approximately the same as the stroke of the toothed racks 30 and 31 so that the advance (feed) of the bag may be set to approximately the double of the stroke of the transverse sealing shoes.

Figure 3:
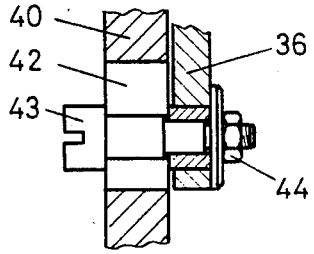
FIG. 3 is a sectional elevational view of one component of the preferred embodiment.

The eccentric drive 37 comprises a belt pulley 40 which is driven by a belt 41 from a motor (not shown). To change the bag length, merely the stroke of the eccentric drive 37 has to be adjusted. For this purpose, in the belt pulley 40 a radial slot 42 is provided (FIG. 3), and by means of a securing screw and nut 43, 44 adjustable in the slot 42, the point of articulation of the control rod 36 with the pulley 40 may be radially varied.

By means of an optical barrier 50 markings 51 on the bags may be monitored. By means of an amplifier and electronic control circuitry of well known design (not shown), an electromagnet 52 is actuated whose armature 53 supports a sensor lever 54. The sensor lever 54 is urged by means of a spring 55 against a cam disc 56 which is rigidly connected with the belt pulley 40 by means of a shaft 58. If the optical barrier 50 emits no signal (no marking 51 is present), the sensor lever 54 is freed and pulls downwardly a plunger 57 which carries the pinion 26. As a result of this occurrence, the gear 24 is rotated by a small angle in the direction of the arrow A and the marking 51 is displaced downwardly by a predetermined extent. This additional step is repeated upon each revolution of the belt pulley 40 when no marking 51 is monitored by the optical barrier 50. The eccentric drive 37 is so adjusted that the sealing rollers 6 advance the webs B1 and B2 slightly less than the pitch of markings 51. For example, after three markings have been advanced and the optical barrier 50 monitors "no marking", the additional step will occur and bring the marking 51 into the correct spot.

It will be understood that the above description of the present invention is susceptible to various modifications, changes and adaptations, and the same are intended to be comprehended within the meaning and range of equivalents of the appended claims.

What is claimed is:

1. A method of driving first and second sealing elements of a packing machine for providing, respectively, longitudinal and transverse seams to travelling, superposed wrapper sheets of indeterminate length to sequentially make sealed bags of predetermined length therefrom; said first sealing elements comprising a pair of cooperating sealing rollers for providing the longitudinal seams; said second sealing elements comprising a pair of cooperating sealing shoes movable towards and away from one another to assume a sealing position and an idling position, respectively; comprising the following steps, repeated cyclically for sealing sealing each bag:

(a) rotating undirectionally said sealing rollers in first and second consecutive, intermittent steps for providing said longitudinal seam in two consecutive length portions each corresponding to one-half said determined length;

(b) moving said sealing shoes, while in said sealing position, codirectionally with the travelling direction of the wrapper sheets for the entire period in which one of said first and second steps is performed, whereby said sealing shoes execute a sealing stroke, whose length corresponds to one-half of said predetermined length, to provide a transverse seam on said wrapper sleeve;

(c) moving said sealing shoes, while in said idling position, against said travelling direction for the entire period in which the other of said first and second steps is performed, whereby said sealing shoes execute a return to move into a starting position; and (d) positively synchronizing steps (b) and (c) with one another.

2. A method as defined in claim 1, further comprising the step of looping said wrapper sheets through more than 90° about respective said sealing rollers.

3. A packing machine for making sealed bags of predetermined length from superposed wrapper sheets of indefinite length comprising:

(a) a pair of cooperating sealing rollers for providing longitudinal seams on superposed wrapper sheets passed therebetween; said sealing rollers being rotatable about respective rotary axes;

(b) a drive shaft operatively connected to said sealing rollers for effecting rotation thereof;

(c) a first and a second gear mounted on said drive shaft for rotation thereon;

(d) first and second freewheeling means mounted, respectively, between said first gear and said drive shaft and said second gear and said drive shaft; said first and second freewheeling means being arranged for transmitting a torque from said first and second gears to said drive shaft when said first and second gears are rotated in a first direction and for transmitting no torque from said first and second gears when said first and second gears are rotated in a second direction opposite said first direction;

(e) a driving means;

(f) a toothed rack unit supported for a back-and-forth motion in opposite third and fourth directions; said toothed rack unit including a first and a second toothed rack connected to one another to move as a rigid structure; said second toothed rack directly meshing with said second gear for rotating said second gear in said first and second directions when said toothed gear unit moves in said third and fourth directions, respectively;

(g) a pinion gear meshing with said first gear and said second toothed rack for rotating said first gear in said first and second directions when said toothed gear unit moves in said fourth and third directions, respectively;

(h) first coupling means connecting said driving means with said toothed rack unit for effecting the motion thereof in said third and fourth directions;

(i) a pair of cooperating sealing shoes movable towards and away from one another for assuming, respectively, a sealing position to provide a transverse seam on the superposed wrapper sheets and an idling position; said sealing shoes being further supported for a back-and-forth travel in opposite fifth and sixth directions downstream of said sealing rollers as viewed in a direction of advance of said wrapper sheets and parallel to said direction of advance; and (j) second coupling means connecting said driving means with said sealing shoes for displacing said sealing shoes in said fifth direction codirectionally with said direction of advance during the displacement of said toothed rack unit in one of said third and fourth directions and for displacing said sealing shoes in said sixth direction against said direction of advance during the displacement of said toothed rack unit in the other of said third and fourth directions.

4. A packing machine as defined in claim 3, wherein said driving means comprises power means and a rotary member driven by said power means and further wherein said first coupling means comprises a crank mechanism connected to said toothed rack unit and an articulation eccentrically connecting said crank mechanism to said rotary member.

5. A packing machine as defined in claim 4, further comprising adjusting means for varying the eccentricity of said articulation.

6. A packing machine as defined in claim 4, wherein said crank mechanism comprises a two-armed lever; support means for pivotally holding said two-armed lever approximately in mid-length thereof; said two-armed lever having opposite first and second ends; said first end being articulated to said toothed rack unit; said crank mechanism further comprising a connecting rod articulated to said second end of said two-armed lever and connected to said articulation.

7. A packing machine as defined in claim 6, wherein said support means comprises a rotary shaft affixed to said two-armed lever; said second coupling means comprising said rotary shaft and a carrier arm affixed to said rotary shaft and carrying said sealing shoes.

8. A packing machine as defined in claim 3, further comprising a plunger supported for back-and-forth movement parallel to the direction of motion of said toothed rack unit; said pinion gear being mounted for rotation on said plunger; further comprising an additional driving means for reciprocating said plunger; and activating means for selectively connecting said additional driving means to or disconnecting said additional driving means from said plunger.

9. A packing machine as defined in claim 8, wherein said additional driving means comprises a rotary cam disc and a pivotally supported sensor lever operatively connectable to said cam disc for being oscillated thereby.

10. A packing machine as defined in claim 9, wherein said driving means comprises a rotary member and said cam disc is rigidly connected with said rotary member; further wherein said activating means comprises a solenoid means operatively coupled to said sensor lever and sensing means for energizing and de-energizing said solenoid means in response to a presence or an absence of a marking on said wrapper sheets.

11. A packing machine as defined in claim 10, wherein said sensing means comprises an optical barrier emitting a signal as a function of a presence or absence of the marking.

12. In a packing machine for making filled and sealed bags of predetermined length from superposed wrapper sheets of indeterminate length introduced into the machine, comprising:

(a) a pair of cooperating sealing rollers for providing longitudinal seams on the superposed wrapper sheets passed therebetween; said sealing rollers being rotatable about respective rotary axes;

(b) means for rotating unidirectionally said sealing rollers in first and second consecutive, intermittent steps for providing said longitudinal seams in two consecutive length portions each corresponding to one-half of said predetermined length;

(c) a pair of cooperating sealing shoes movavle towards and away from one another for assuming, respectively, a sealing position to provide a transverse seam on the superposed wrapper sheets and an idling position; said sealing shoes being further supported for a back-and-forth travel downstream of said sealing rollers as viewed in a direction of advance of said wrapper sheets and parallel to said direction of advance;

(d) means for moving said sealing shoes, while in said sealing position, codirectionally with the travelling direction of the wrapper sheets for the entire duration in which one of said first and second steps is performed, whereby said sealing shoes execute a sealing stroke, whose length corresponds to one-half of said predetermined length, to provide a transverse seam on said wrapper sleeve and for moving said sealing shoes, while in said idling position, against said travelling direction for the enitre period in which the other of said first and second steps is performed, whereby said sealing shoes execute a return stroke to move into a starting position; and (e) means for positively synchronizing motions of said sealing rollers with motions of said sealing shoes for effecting performance of said sealing and return strokes of said sealing shoes simultaneously with the first and second consecutive, intermittent steps of rotation of said sealing rollers.

13. A packing machine as defined in claim 12, wherein said means for rotating undirectionally said sealing rollers, said means for moving said sealing shoes and said means for positively synchronizing motions comprise (a) actuating means for performing a back-and-forth motion;

(b) first connecting means coupled to said pair of cooperating sealing rollers and to said actuating means for converting said back-and-forth motion into a unidirectional, intermittent torque and for applying said torque to said pair of cooperating sealing rollers;

(c) second connecting means coupled to said pair of cooperating sealing shoes and to said actuating means for applying a back-and-forth oriented force to said pair of cooperating sealing shoes; and (d) driving means connected to said actuating means for imparting said back-and-forth motion to said actuating means.

* * * * *